US007425975B2

(12) United States Patent
Ono et al.

(10) Patent No.: US 7,425,975 B2
(45) Date of Patent: Sep. 16, 2008

(54) MULTI-BEAM IMAGE FORMING APPARATUS

(75) Inventors: Katsuhiro Ono, Ibaraki (JP); Junshin Sakamoto, Ibaraki (JP); Takeshi Mochizuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 462 days.

(21) Appl. No.: 11/293,108

(22) Filed: Dec. 5, 2005

(65) Prior Publication Data

US 2006/0139441 A1 Jun. 29, 2006

(30) Foreign Application Priority Data

Dec. 7, 2004 (JP) ..... P2004-353562

(51) Int. Cl.
*B41J 2/455* (2006.01)
*B41J 2/47* (2006.01)

(52) U.S. Cl. ..... 347/233; 347/235

(58) Field of Classification Search ..... 347/128, 347/233, 238, 234, 235; 250/234, 235; 359/204; 358/1.7

See application file for complete search history.

(56) References Cited

U.S. PATENT DOCUMENTS 5,834,766 A * 11/1998 Suhara ..... 250/234
5,883,385 A * 3/1999 Takahashi et al. ..... 250/235
5,963,242 A * 10/1999 Nakayama et al. ..... 347/238
6,570,675 B1 * 5/2003 Asada ..... 358/1.7
6,661,444 B2 * 12/2003 Komiya et al. ..... 347/235
2001/0035999 A1 * 11/2001 Saito et al. ..... 359/204
2004/0119003 A1 * 6/2004 Ikeda ..... 250/234

FOREIGN PATENT DOCUMENTS

JP 6-344592 12/1994
JP 10-202943 8/1998

* cited by examiner

*Primary Examiner*—Stephen D Meier
*Assistant Examiner*—Carlos A Martinez, Jr.
(74) *Attorney, Agent, or Firm*—McGinn IP Law Group, PLLC

(57) ABSTRACT

A multi-beam image forming apparatus includes: first and second semiconductor laser arrays each having n laser elements; a multi-beam generation unit that generates 2n laser beams by synthesizing laser beams generated by the first and second semiconductor laser arrays; a beam detection unit that generates synchronous detection signals to obtain synchronous scanning of the respective laser beams; and a control unit. The beam detection unit includes first and second beam detection units disposed substantially at a same position in a main scanning direction and adjacently disposed in a sub-scanning direction. The n laser beams of the first and second semiconductor laser arrays are detected by the first and second beam detection unit, respectively. The control unit controls image formation start positions of the 2*n* laser beams on the basis of the synchronous detection signals output from the first and the second beam detection units.

12 Claims, 8 Drawing Sheets

MULTI-BEAM IMAGE FORMING APPARATUS

BACKGROUND OF THE INVENTION

1. Field of the Invention

The present invention relates to an image forming apparatus using a multi-beam scanner for performing simultaneous scanning with a plurality of beams. Particularly it relates to a multi-beam image forming apparatus in which image formation start positions can be aligned to thereby obtain a high-quality image even in the case where a large number of beams are used.

2. Description of the Related

In an electrophotographic apparatus such as a laser printer, a digital copying machine, etc., after a photoconductor drum is charged evenly, an electrostatic latent image is formed on the photoconductor drum in accordance with recording information by an exposure device using laser beams. The electrostatic latent image is developed with toner to form a toner image. The toner image is transferred onto a sheet of paper by a transfer unit. Further, the toner image is fixed to thereby form an image on the sheet of paper.

As this type of image forming apparatus, there has been heretofore proposed a multi-beam image forming apparatus having a multi-beam scanner using a polygon mirror for simultaneously scanning a plurality of line with a plurality of laser beams. This type of multi-beam image forming apparatus has such a characteristic that a low-speed rotation polygon motor and low-power semiconductor lasers can be used for forming an image at a high speed because an image corresponding to the plurality of lines is formed by one surface of the polygon mirror.

In the multi-beam image forming apparatus, alignment of image formation start positions of the plurality of laser beams is not only necessary for simultaneous recording of image data corresponding to the plurality of lines with the laser beams, but also essential for achievement of high image quality. For this reason, there is used a control method in which positions after a predetermined time distance from beam detection signals output from a laser beam detection unit that is disposed in a predetermined position out of an effective scanning range and is irradiated with laser beams are set as image formation start positions, prior to start of image formation.

When, for example, a plurality of laser beams are aligned in a main scanning direction, one of the laser beams is emitted and applied on a beam detection unit so that the image formation start positions of all the laser beams can be controlled on the basis of the beam detection signal output from the beam detection unit in the same manner as in an image forming apparatus using one laser beam. In this method, accuracy in synthesizing the plurality of laser beams is however limited. Even in the case where the plurality of laser beams can be synthesized accurately, it is inevitable that accuracy in synthesizing is lowered with the passage of time because of the influence of environmental change, vibration, etc. Accordingly, it is difficult to always align the image formation start positions of the laser beams in the main scanning direction stably.

To solve this problem, JP-A-10-202943 discloses a method for controlling the image formation start positions of laser beams respectively.

FIG. 13 is a schematic view showing part of an image forming apparatus for explaining the aforementioned method. In FIG. 13, the reference numeral 1 designates a polygon mirror; 2, an imaging lens system; 3, a mirror; 4, a photoconductor drum; 5, a synchronous detection unit; and 6, a laser control unit.

LD1 and LD2 designate first and second semiconductor laser beam sources respectively. Laser beams emitted from the two laser beam sources LD1 and LD2 are reflected by a deflection/reflection surface of the polygon mirror 1 so as to be distributed horizontally. Then, the laser beams are changed into convergent beams by the imaging lens system 2 such as an fθ lens. The optical path of the laser beams is bent downward by the mirror 3. The laser beams are focused as two light spots S1 and S2 on the photoconductor drum 4. The photoconductor drum 4 is scanned with the two light spots S1 and S2 simultaneously in the main scanning direction to thereby form an electrostatic latent image.

The first and second semiconductor laser beam sources LD1 and LD2 are adjacently disposed in the main scanning direction so that the light spots S1 and S2 are formed so as to be separated from each other at a slight distance P corresponding to resolution as shown in FIG. 14. For this reason, the positions of the two light spots S1 and S2 for scanning the photoconductor drum 4 or the synchronous detection unit 5 are shifted by a distance L in the main scanning direction, so that a time difference corresponding to the distance L is generated when the two light spots S1 and S2 are incident on a light-receiving surface 5*a* of the synchronous detection unit 5.

Accordingly, when the semiconductor laser beam sources LD1 and LD2 are made to emit light at the timing exemplified in FIG. 15, synchronous signal outputs (A) and (B) corresponding to the light spots S1 and S2 are obtained from the light-receiving surface 5*a* of the synchronous detection unit 5. When the semiconductor laser beam sources LD1 and LD2 are controlled by the laser control unit 6 on the basis of the synchronous signals (A) and (B), the start positions of the laser beams in the main scanning direction can be always controlled stably.

In the control method, there is however a problem that the effective scanning range is narrowed when the semiconductor laser beam sources are formed as an array to increase the number of laser beams, for example, to ten laser beams.

That is, when ten laser beam spots S1 to S10 are shifted at regular intervals in the main scanning direction and the sub-scanning direction orthogonal to the main scanning direction as shown in FIG. 16, scanning due to the laser beams is expressed as shown in FIG. 17. The effective scanning range of the laser beams is decided as a predetermined range R1 from the image formation start position X because the effective scanning range is a range in which all the scanned lines by the laser beam spots S1 to S10 overlap. Accordingly, if imaging is performed as shown in FIG. 16, the overlapping portion is reduced so that the problem of narrowing the effective scanning range cannot be avoided.

On the other hand, JP-A-6-344592 discloses a method in which two beam detection units are adjacently disposed in the main scanning direction so that the beam of the first semiconductor laser is detected by the first beam detection unit while the beam of the second semiconductor laser is detected by the second beam detection unit to thereby generate a synchronous signal (beam detection signal) as a reference signal for aligning the image formation start positions.

Also in this method, the scanning range for detecting the beams however becomes long because the plurality of beam detection units are adjacently disposed in the main scanning direction. As a result, there is a problem that the effective scanning range is narrowed.

SUMMARY OF THE INVENTION

The present invention has been made in view of the above circumstances and provides a multi-beam image forming apparatus.

Specifically, the invention provides a multi-beam image forming apparatus in which the image formation start position of each laser beam in a main scanning direction can be always controlled stably even in the case where accuracy in synthesizing a plurality of laser beams is lowered with the passage of time and in which an effective scanning range is prevented from being narrowed even in the case where the number of laser beams is increased.

According to an aspect of the present invention, there is provided a multi-beam image forming apparatus including: a first semiconductor laser array having n laser elements, wherein n is an integer not smaller than 2; a second semiconductor laser array having n laser elements; a multi-beam generation unit that generates 2n laser beams by synthesizing laser beams generated by the first and second semiconductor laser arrays; a scanning unit that scans with the 2n laser beams generated by the multi-beam generation unit; a beam detection unit that generates synchronous detection signals to obtain synchronous scanning of the respective laser beams; and a control unit. The beam detection unit includes a first and second beam detection unit disposed substantially at a same position in a main scanning direction and adjacently disposed in a sub-scanning direction orthogonal to the main scanning direction. The n laser beams of the first semiconductor laser array are detected by the first beam detection unit while the n laser beams of the second semiconductor laser array are detected by the second beam detection unit. The control unit controls image formation start positions of the 2n laser beams on the basis of the synchronous detection signals output from the first and the second beam detection unit.

According to another aspect of the present invention, there is provided a multi-beam image forming apparatus including: a first semiconductor laser array having n laser elements, wherein n is an integer not smaller than 2; a second semiconductor laser array having n laser elements; a multi-beam generation unit that generates 2n laser beams by synthesizing laser beams generated by the first and second semiconductor laser arrays; a scanning unit that scans with the 2n laser beams generated by the multi-beam generation unit; a beam detection unit that generates synchronous detection signals to obtain synchronous scanning of the respective laser beams; and a control unit. The beam detection unit includes a first and second beam detection unit disposed in positions shifted by a predetermined distance L1 from each other in a main scanning direction and adjacently disposed in a sub-scanning direction orthogonal to the main scanning direction. The n laser beams of the first semiconductor laser array are detected by the first beam detection unit while the n laser beams of the second semiconductor laser array are detected by the second beam detection unit. The control unit controls image formation start positions of the 2n laser beams on the basis of the synchronous detection signals output from the first and the second beam detection unit.

BRIEF DESCRIPTION OF THE DRAWINGS

Embodiments of the present invention will be described in detail based on the following figures, wherein.

DETAILED DESCRIPTION OF THE INVENTION

The best mode for carrying out the invention will be described below with reference to the drawings.

Embodiment 1

Figure 1:
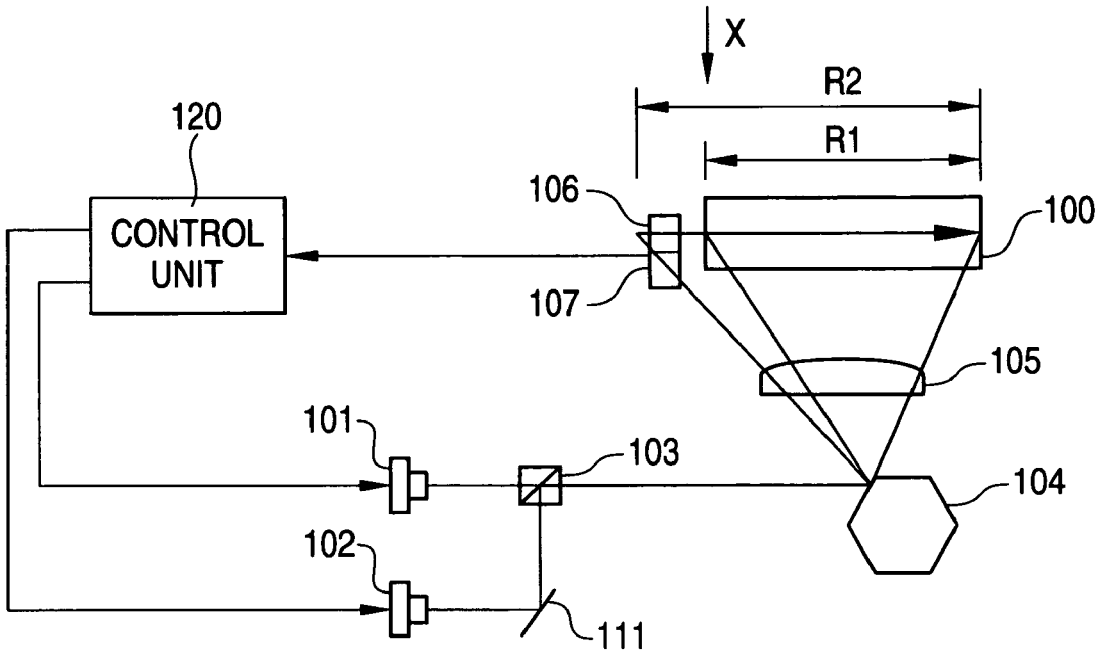
FIG. 1 is a schematic configuration view showing a chief unit of a multi-beam image forming apparatus according to a first embodiment of the invention.

FIG. 1 is a partial schematic configuration view showing a multi-beam image forming apparatus according to a first embodiment of the invention. In FIG. 1, a photoconductor drum 100 is driven to rotate by a motor not shown. After a surface of the photoconductor drum 100 is charged evenly by a charger not shown, laser beams are applied on the surface of the photoconductor drum 100 in accordance with recording information to thereby form an electrostatic latent image. The electrostatic latent image is developed by a developing device (not shown) and further transferred onto a sheet of recording paper or the like by a transfer device (not shown) to thereby form an image.

Each of semiconductor laser arrays (hereinafter referred to as "LDA") 101 and 102 generates a plurality of laser beams in accordance with image data. After the laser beams generated by the LDA 102 are reflected by a mirror 111 which is a deflection unit, the laser beams are incident on a beam splitter 103 and are synthesized with the laser beams emitted from the LDA 101. The synthesized laser beams are applied on a deflection/reflection surface of a polygon mirror 104 which is a scanning unit for scanning the surface of the photoconductor drum 100. The laser beams from the polygon mirror 104 are imaged on the photoconductor drum 100 via an imaging unit such as an fθ lens 105. Light spots of the imaged laser beams are formed at regular intervals in a sub-scanning direction while the surface of the photoconductor drum 100 is scanned at a uniform velocity. For example, in the case of resolution of 600 dpi, the light spots of the imaged laser beams are formed on the photoconductor drum while shifted from each other at intervals of 42.3 μm in the sub-scanning direction.

The laser beams generated by the first LDA 101 and the laser beams generated by the second LDA 102 are formed at regular intervals in a main scanning direction. The m-th one (wherein m is an integer not smaller than 2) of the laser beams generated by the first LDA 101 and the m-th one of the laser beams generated by the second LDA 102 are synthesized with each other by the beam splitter 103 so that the positions of the m-th laser beams in the main scanning direction are adjusted to be aligned with each other.

Figure 2:
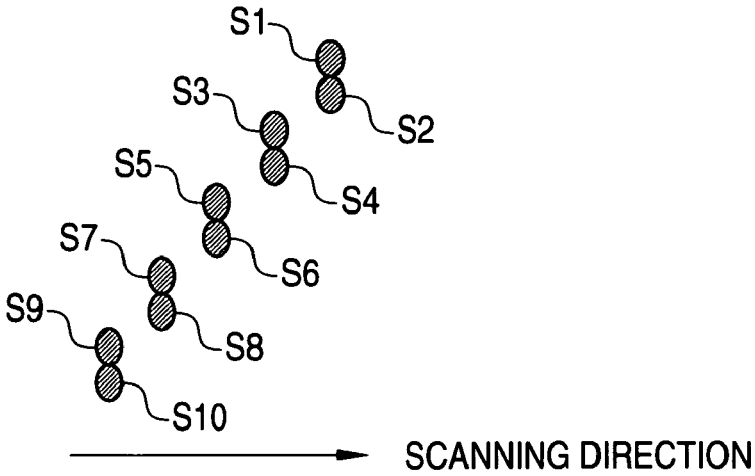
FIG. 2 is an explanatory view showing the positional relation among a plurality of beams generated in the apparatus according to the invention.

FIG. 2 shows the positional relation among ten laser beams (S1 to S10) imaged on the photoconductor drum when n is equal to 5, that is, when five-element LDAs are used. That is, in this embodiment, odd-number laser beams S1, S3, S5, S7 and S9 generated by the LDA 101 and even-number laser beams S2, S4, S6, S8 and S10 generated by the LDA 102 are imaged so that the laser beams S1 and S2, the laser beams S3 and S4, . . . , the laser beams S9 and S10 are aligned with each other in the main scanning direction.

On the other hand, beam detection units 106 and 107 in FIG. 1 are disposed so as to be adjacent to the photoconductor drum 100. That is, the beam detection units 106 and 107 are disposed within R2 and in front of X where R2 is an allowable laser beam scanning range, R1 is an effective scanning range and X is an image formation start position as shown in FIG. 1. In this embodiment, the two detection units 106 and 107 are disposed adjacently in the sub-scanning direction as will be described later.

Figure 3:
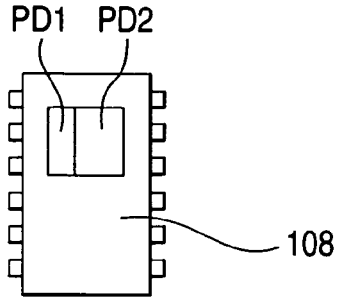
FIG. 3 is an explanatory view showing a photo IC used in the apparatus according to the invention.

Each of the beam detection units 106 and 107 has two photodiodes (hereinafter referred to as "PD1" and "PD2") for photoelectrically converting the laser beams. In this embodiment, the PD1, PD2 and a conversion circuit form a photo IC 108. Though not described in detail, the conversion circuit is a circuit for comparing the output PD1OUT of the PD1 and the output PD2OUT of the PD2 with each other and generating an on/off digital signal in accordance with a result of the comparison. FIG. 3 is a schematic view of the photo IC 108.

Figure 4:
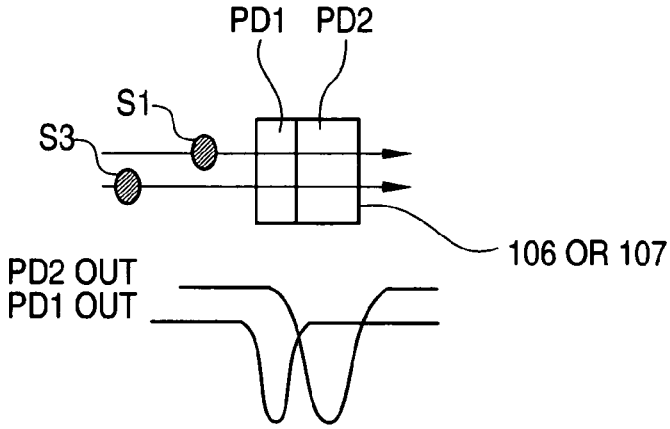
FIG. 4 is a view for explaining the operation of a beam detection unit used in the apparatus according to the invention.

Assuming now that the PD1 and PD2 formed in the beam detection unit 106 or 107 are scanned with two laser beams, for example, S1 and S3 as shown in FIG. 4, then the PD1 is turned on only during application of the first laser beam S1 on the PD1 but the PD1 is turned off when the first laser beam S1 is not applied on the PD1. Likewise, the PD2 is turned on during application of the laser beam S1 on the PD2 but the PD2 is turned off when the laser beam S1 is not applied on the PD2. Succeedingly, the second laser beam S3 is applied and the same operation as described above is carried out. The conversion circuit in the photo IC 108 compares PD1OUT and PD2OUT with each other and operates so that, for example, a low-level detection signal (L) is output in the case of PD1OUT>PD2OUT but a high-level detection signal (H) is output in the case of PD2OUT>PD1OUT.

Figure 5A:
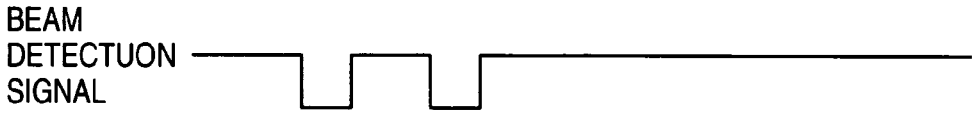
FIG. 5A to 5C are explanatory views for explaining the timing of the image formation start position in the invention.
Figure 5B:
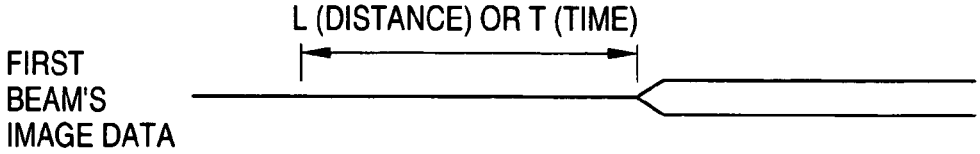
Figure 5C:
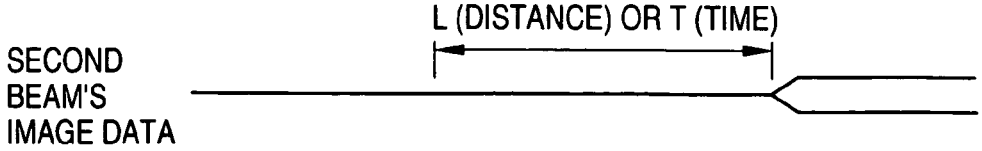

FIG. 5A is a waveform view of the detection signal output from the photo IC 108. The first pulse expresses a signal which is generated when the PD1 and PD2 are scanned with the laser beam S1. The second pulse expresses a signal which is generated when the PD1 and PD2 are scanned with the laser beam S3. These detection signals are supplied to a control unit 120 in FIG. 1. The control unit 120 controls the LDAs 101 and 102 to generate first beam's image data with the position after a predetermined distance L or a predetermined time T from the first pulse as an image formation start position as shown in FIG. 5B and to generate second beam's image data with the position after the predetermined distance L or the predetermined time T from the second pulse as an image formation start position as shown in FIG. 5C.

Incidentally, in this embodiment, such a pair of laser beams cannot be detected by one beam detection unit because the light spots of the laser beams (S1 and S2), (S3 and S4), . . . , (S9 and S10) are imaged so as to be aligned in the main scanning direction as shown in FIG. 2.

Figure 6:
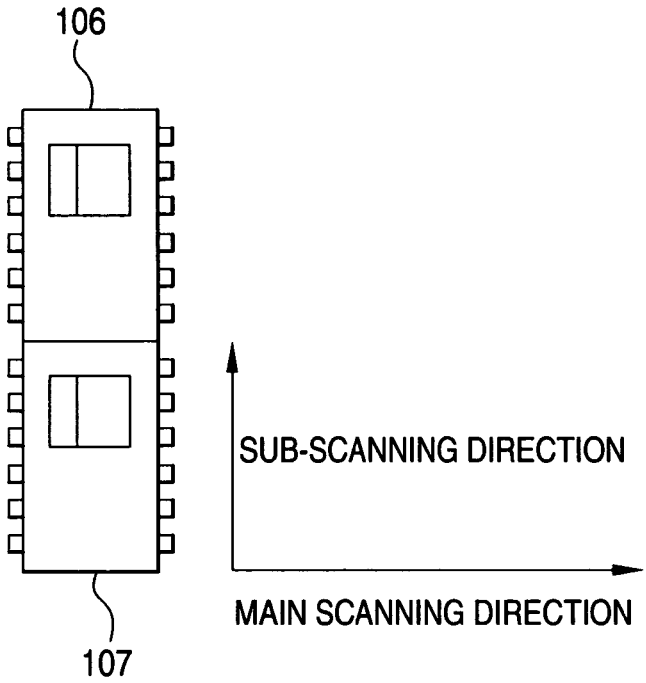
FIG. 6 is an explanatory view showing an example of arrangement of beam detection units in the invention.

Therefore, in the first embodiment of the invention, two beam detection units 106 and 107 are used as shown in FIG. 6. The two beam detection units 106 and 107 are disposed substantially at a same position in the main scanning direction and disposed adjacently in the sub-scanning direction. The deflection unit 111 is provided so that the beam detection unit 106 is scanned with the laser beams S1, S3, S5, S7 and S9 while the beam detection unit 107 is scanned with the laser beams S2, S4, S6, S8 and S10 at the time of beam detection.

Figure 7:
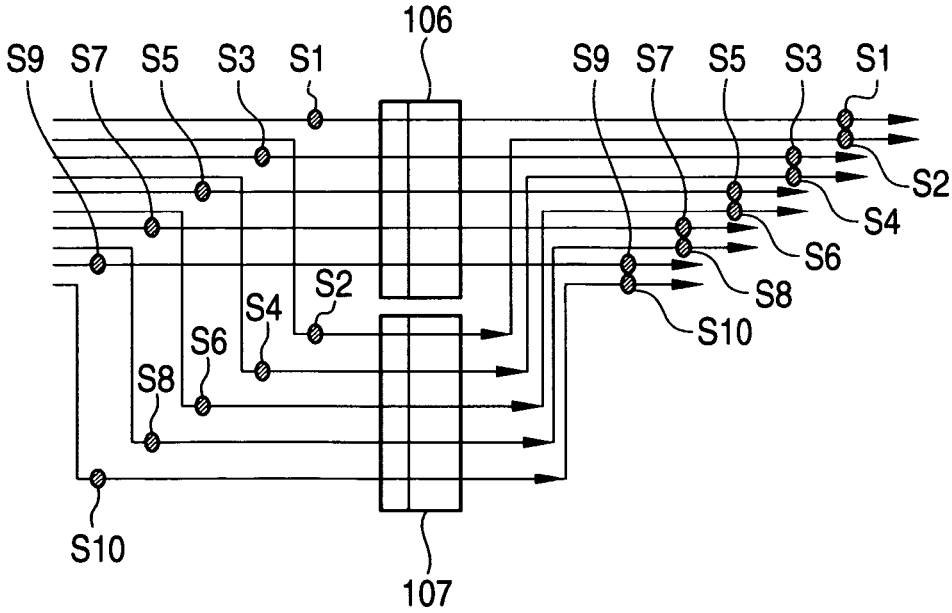
FIG. 7 is an explanatory view showing an example of a method for detecting a plurality of beams having the positional relation shown in FIG. 2.

That is, the deflection unit 111 such as a prism, or a galvanomirror is disposed in an optical path of the LDA 102 and the beam splitter 103 in FIG. 1. When respective laser beams are to be detected by the beam detection units 106 and 107, the vertex angle of the prism or the angle of a reflection surface of the galvanomirror is adjusted to change the laser beam optical path of the LDA 102, as shown in FIG. 7. This embodiment is configured so that the laser beams S1, S3, S5, S7 and S9 of the LDA 101 pass through the beam detection unit 106 but the laser beams S2, S4, S6, S8 and S10 of the LDA 102 pass through an upper surface of the beam detection unit 107 after the optical path is changed by the deflection unit 111. As a result, all the laser beams can be detected. After the beam detection, the positional relation among the laser beams is returned to the positional relation shown in FIG. 2 by the deflection unit 111 so that the image formation start positions are controlled on the basis of the beam detection signals.

Figure 8:
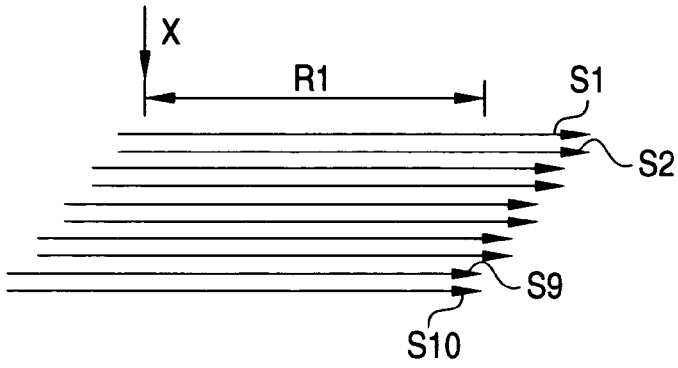
FIG. 8 is an explanatory view showing the effective scanning range of the plurality of beams in the invention.

According to the aforementioned embodiment, the effective scanning range R1 can be widened compared with the background art because scanning with the laser beams S1 to S10 is performed as shown in FIG. 8.

Embodiment 2

Figure 9:
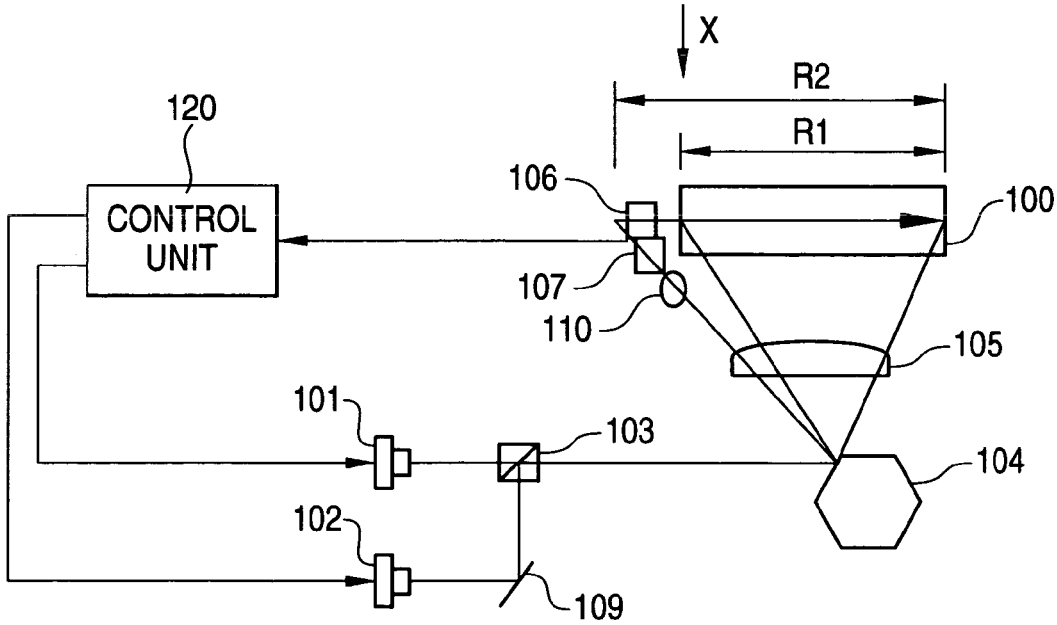
FIG. 9 is a schematic configuration view showing a chief unit of a multi-beam image forming apparatus according to a second embodiment of the invention.
Figure 10:
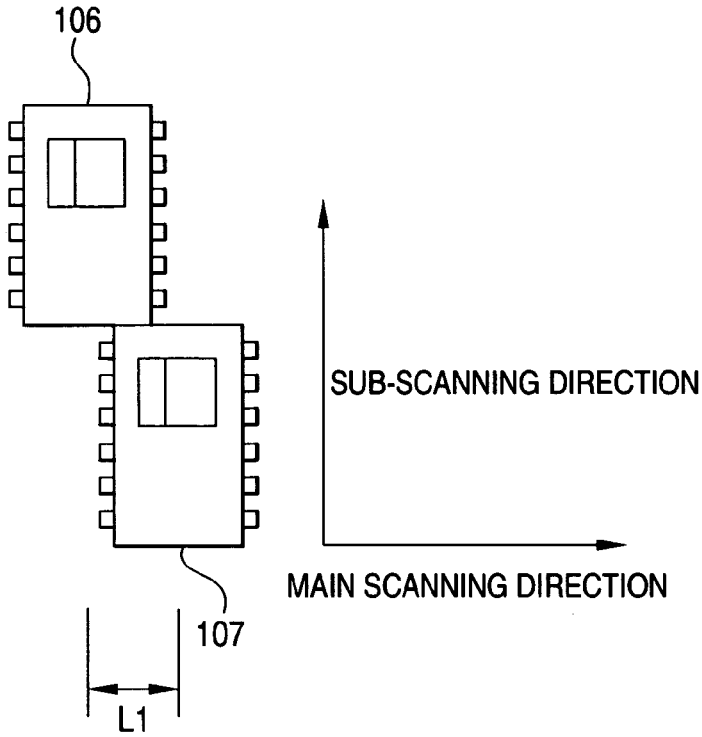
FIG. 10 is an explanatory view showing another example of arrangement of beam detection units in the invention.
Figure 11:
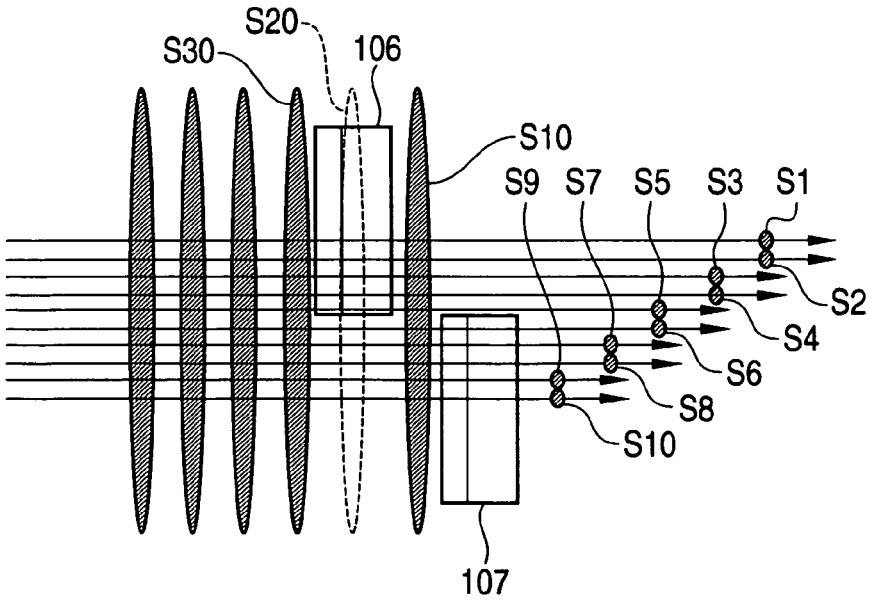
FIG. 11 is an explanatory view for explaining the operation of the apparatus according to the second embodiment of the invention.

FIGS. 9 and 10 show a second embodiment of the invention. The beam detection units 106 and 107 are disposed adjacently in the sub-scanning direction while shifted by a slight distance L1 from each other in the main scanning direction to prevent the effective scanning range from being narrowed. Configuration is also made that a cylindrical lens 110 is disposed in an optical path between the fθ lens 105 and the beam detection units 106 and 107 at the time of beam detection. When the cylindrical lens 110 is inserted in the optical path, the laser beams are formed as vertically longer beams S10, S20, S30 . . . as shown in FIG. 11.

Incidentally, in FIG. 9, the same constituent parts as in FIG. 1 are referred to by the same numerals so that description of the parts will be omitted. Although FIG. 1 shows the case where the deflection unit 111 is disposed in the optical path which leads the optical beams from the second semiconductor laser array (LDA) 102 to the beam splitter 103, FIG. 9 shows the case where an ordinary reflection mirror 109 is used because the optical beams need not be deflected in the embodiment shown in FIG. 9.

Next, the operation of the control unit 120 will be described with reference to FIGS. 12A to 12L. FIGS. 12B to 12F show the light-emitting timing of the LDA 101, FIG. 12A shows the detection signal waveform of the beam detection unit 106, FIGS. 12H to 12L show the light-emitting timing of the LDA 102, and FIG. 12G shows the detection signal waveform of the beam detection unit 107.

Figures 12A, 12B, 12C, 12D, 12E, 12F, 12G, 12H, 12I, 12J, 12K, 12L:
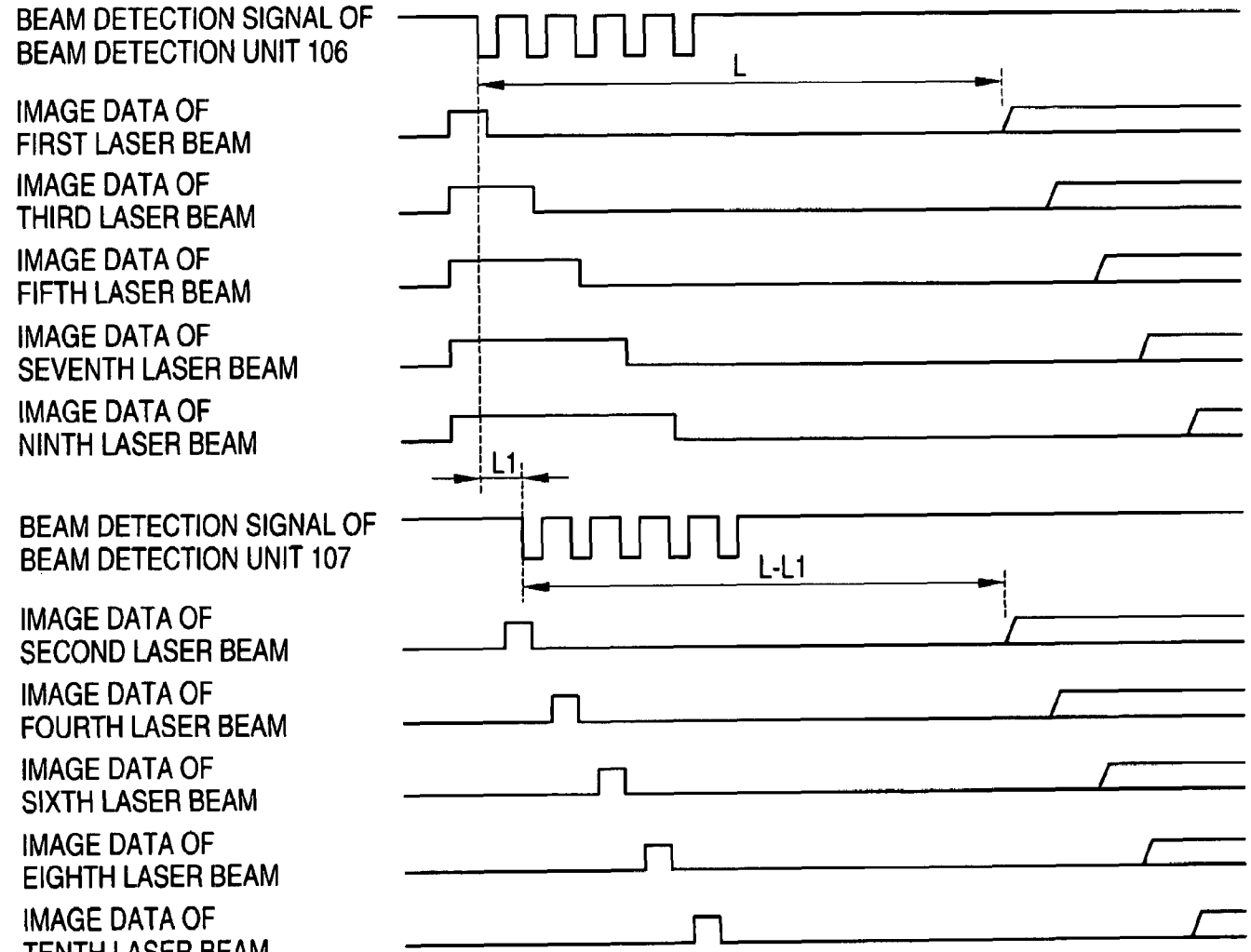
FIGS. 12A to 12L are waveform charts of respective portions for explaining the operation of the apparatus according to the second embodiment of the invention.
Figure 13:
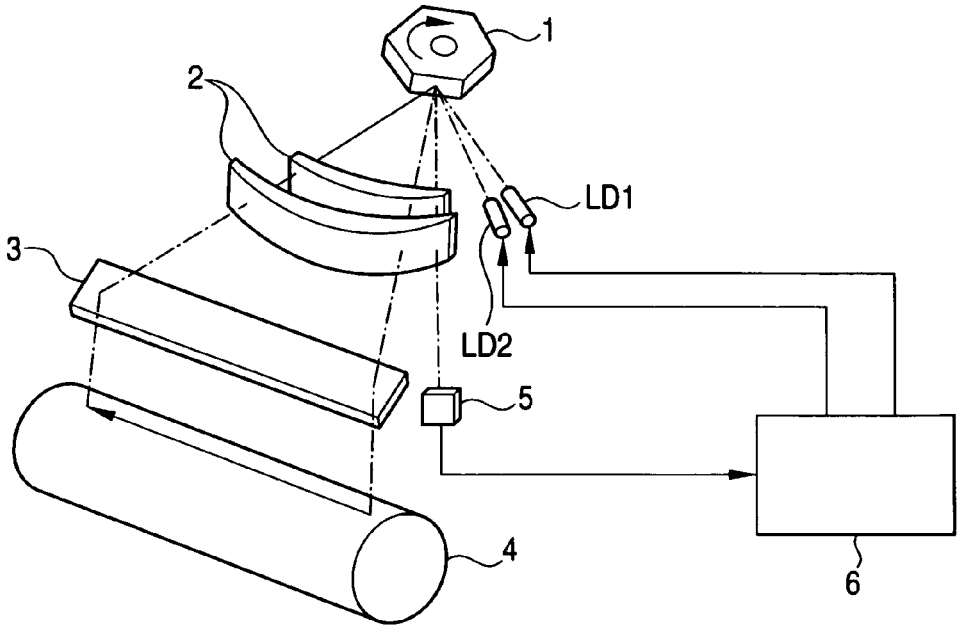
FIG. 13 is a schematic configuration view showing a chief unit of a multi-beam image forming apparatus according to the related art.
Figure 14:
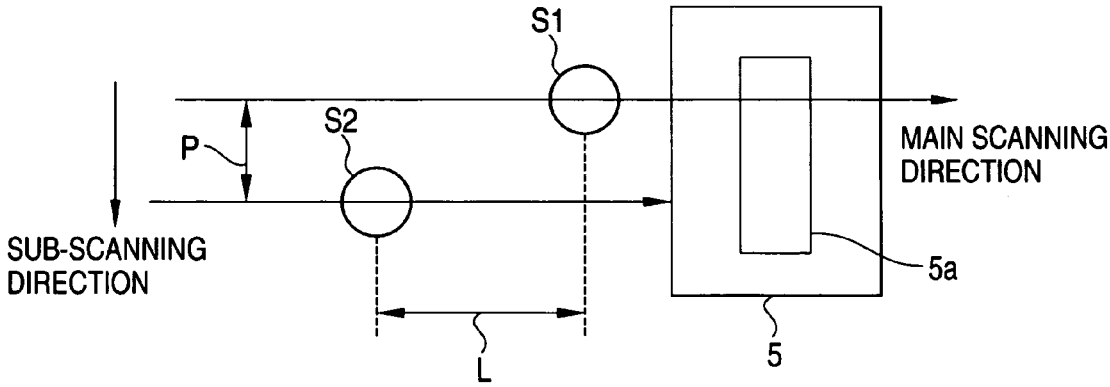
FIG. 14 is a view for explaining a synchronous signal detection unit in the apparatus according to the related art.
Figure 15:
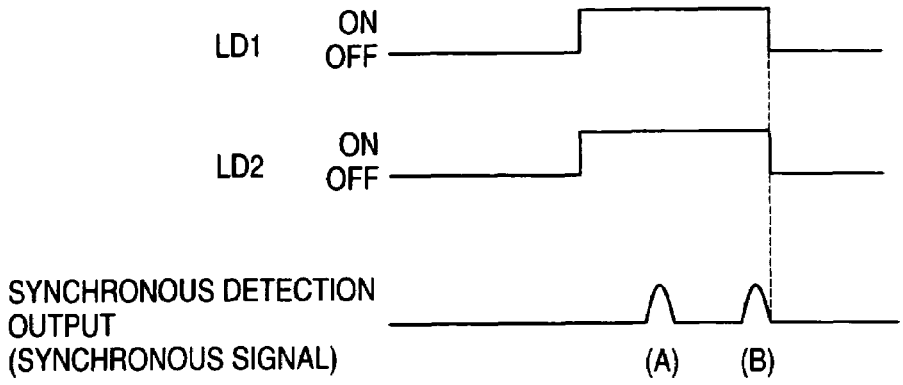
FIG. 15 is a view for explaining the operation of the synchronous signal detection unit in the apparatus according to the related art.
Figure 16:
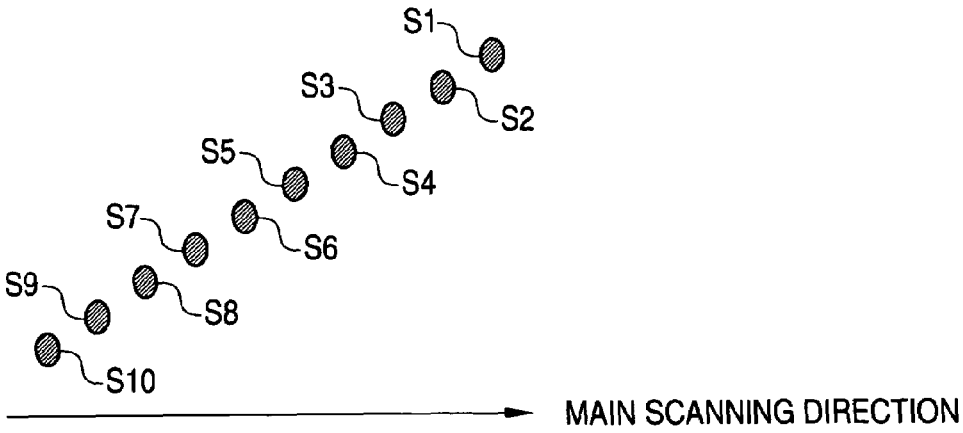
FIG. 16 is an explanatory view showing the positional relation among a plurality of beams generated in the apparatus according to the related art.
Figure 17:
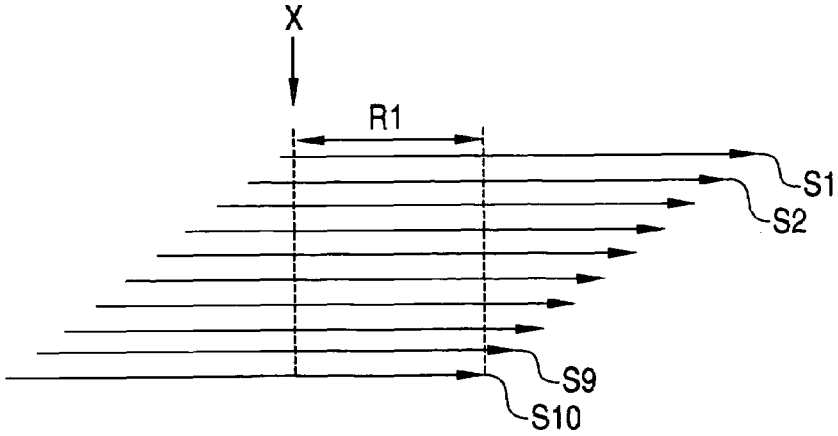
FIG. 17 is an explanatory view showing the effective scanning range of the plurality of beams in the apparatus according to the related art.

First of all, the LDA 101 is made to emit light for a predetermined time at the time of passage of each laser beam of the LDA 101 through the beam detection unit 106 as shown in FIG. 12B. The light emitted from the LDA 101 is converted into a vertically long spot as represented by S10 in FIG. 11 by the cylindrical lens 110. The vertically long spot passes through the beam detection unit 106. When the first laser beam S10 passes through the beam detection unit 106, the first pulse signal in FIG. 12A is output from the detection unit. Then, the first laser beam S10 is vanished. There is no detection signal generated by the detection unit 107 because the first laser beams S10 has been not emitted at the time of passage through the beam detection unit 107.

On the other hand, the LDA 102 is turned off when the laser beam S20 emitted from the LDA 102 passes through the beam detection unit 106 but light is emitted for a predetermined time when the laser beam S20 passes through the beam detection unit 107 as shown in FIG. 12H. As a result, a detection signal as represented by the first pulse in FIG. 12G is generated by the beam detection unit 107. Next, the LDA 101 is made to emit light for a predetermined time as shown in FIG. 12C. When the third beam passes through the beam detection unit 106, a detection signal as represented by the second pulse in FIG. 12A is generated by the detection unit 106.

The third beam is turned off at the time of passage through the beam detection unit 106, so that the third beam has been off at the time of passage through the beam detection unit 107.

The LDA 102 is made to emit light for a predetermined time in the same manner at the timing shown in FIG. 12I. Because this timing is such timing that the LDA 102 is turned off when the beam passes through the beam detection unit 106 but the LDA 102 is turned on when the beam passes through the beam detection unit 107, a detection signal as represented by the second pulse in FIG. 12G is generated by the beam detection unit 107.

In the same manner as described above, the LDA 101 is made to emit light as shown in FIGS. 12D, 12E and 12F while the LDA 102 is made to emit light at the timing as shown in FIGS. 12J, 12H and 12L. As a result, detection signals as shown in FIG. 12A are generated from the beam detection unit 106 while detection signals as shown in FIG. 12G are generated from the beam detection unit 107, so that all the laser beams are detected.

The control unit 120 decides the image formation start position on the basis of the beam detection signals generated by the beam detection unit 106 and 107. That is, assuming that the image formation start position of image data due to the LDA 101 is at a time distance L from the synchronous detection signal of the detection unit 106, then the image formation start position of image data due to the LDA 102 is decided to be at a time distance (L−L1) from the synchronous detection signal of the detection unit 107.

After the beam detection, there in no influence of the cylindrical lens 110. For this reason, the laser beams generated by the LDAs 101 and 102 have the positional relation as shown in FIG. 2.

As was described, according to an aspect of the invention, the multi-beam generation unit includes a deflection unit that deflects a beam optical path so that the laser beams generated from the second semiconductor laser array are incident on the second beam detection unit when the n laser beams generated from the second semiconductor laser array are detected.

According to another aspect of the invention, the multi-beam generation unit includes a deflection unit that deflects a beam optical path so that the laser beams generated from the second semiconductor laser array pass through the second beam detection unit when the n laser beams generated from the second semiconductor laser array are detected.

According to still another aspect of the invention, the multi-beam image apparatus further includes an optical element disposed between the scanning unit and the beam detection unit. The optical element deforms the laser beams generated from the first semiconductor laser array and second semiconductor laser array so that each of the deformed laser beams has a shape allowing the laser beam to be incident on both the first and second beam detection unit.

According to the invention, a high-quality image can be obtained because a plurality of laser beams are detected and the image formation start positions of the multi-beams are aligned on the basis of the detection signals. Because configuration is made so that two beam detection units are disposed substantially at a same position in the main scanning direction and adjacently in the sub-scanning direction, the area occupied by the beam detection unit in the main scanning direction can be reduced to thereby widen the effective scanning range of the laser beams.

The entire disclosure of Japanese Patent Application No. 2004-353562 filed on Dec. 7, 2004 including specification, claims, drawings and abstract is incorporated herein be reference in its entirety.

What is claimed is:

1. A multi-beam image forming apparatus comprising:

a first semiconductor laser array having n laser elements, wherein n is an integer not smaller than 2;

a second semiconductor laser array having n laser elements;

a multi-beam generation unit that generates 2n laser beams by synthesizing laser beams generated by the first and second semiconductor laser arrays;

a scanning unit that scans with the 2n laser beams generated by the multi-beam generation unit;

a beam detection unit that generates synchronous detection signals to obtain synchronous scanning of the respective laser beams; and a control unit;

wherein the beam detection unit includes first and second beam detection units disposed substantially at a same position in a main scanning direction and adjacently disposed in a sub-scanning direction orthogonal to the main scanning direction;

wherein the n laser beams of the first semiconductor laser array are detected by the first beam detection unit while the n laser beams of the second semiconductor laser array are detected by the second beam detection unit; and wherein the control unit controls image formation start positions of the 2n laser beams on the basis of the synchronous detection signals output from the first and the second beam detection units.

2. A multi-beam image forming apparatus according to claim 1, wherein, when the n laser beams generated from the second semiconductor laser array are detected by the beam detection unit, the multi-beam generation unit includes a deflection unit that deflects a beam optical path so that the laser beams generated from the second semiconductor laser array are incident on the second beam detection unit.

3. A multi-beam image forming apparatus comprising:

a first semiconductor laser array having n laser elements, wherein n is an integer not smaller than 2;

a second semiconductor laser array having n laser elements;

a multi-beam generation unit that generates 2n laser beams by synthesizing laser beams generated by the first and second semiconductor laser arrays;

a scanning unit that scans with the 2n laser beams generated by the multi-beam generation unit;

a beam detection unit that generates synchronous detection signals to obtain synchronous scanning of the respective laser beams; and a control unit;

wherein the beam detection unit includes first and second beam detection units disposed in positions shifted by a predetermined distance L1 from each other in a main scanning direction and adjacently disposed in a sub-scanning direction orthogonal to the main scanning direction;

wherein the n laser beams of the first semiconductor laser array are detected by the first beam detection unit while the n laser beams of the second semiconductor laser array are detected by the second beam detection unit; and wherein the control unit controls image formation start positions of the 2n laser beams on the basis of the synchronous detection signals output from the first beam and the second beam detection units.

4. A multi-beam image forming apparatus according to claim 3, wherein, when the n laser beams generated from the second semiconductor laser array are detected by the beam detection unit, the multi-beam generation unit includes a deflection unit that deflects a beam optical path so that the laser beams generated from the second semiconductor laser array are incident on the second beam detection unit.

5. A multi-beam image forming apparatus according to claim 3, further comprising:

an optical element disposed between the scanning unit and the beam detection unit;

wherein the optical element deforms the laser beams generated from the first semiconductor laser array and second semiconductor laser array so that each of the deformed laser beams has a shape allowing the laser beam to be incident on both the first and second beam detection unit.

6. A multi-beam image forming apparatus according to claim 5, wherein the control unit controls the first semiconductor laser array and second semiconductor laser array so that the first semiconductor laser array is turned off when each of the laser beams generated from the first semiconductor laser array are incident on the second beam detection unit while the second semiconductor laser array is turned off when each of the laser beams generated from the second semiconductor laser array are incident on the first beam detection unit.

7. A multi-beam image forming apparatus comprising:

a first semiconductor laser array having n laser elements, wherein n is an integer not smaller than 2;

a second semiconductor laser array having n laser elements;

a multi-beam generation unit that generates 2n laser beams by synthesizing laser beams generated by the first and second semiconductor laser arrays;

a photo conductor;

a scanning unit that scans the photo conductor with the 2n laser beams generated by the multi-beam generation unit;

a beam detection unit including first and second beam detection units disposed substantially at a same position in a main scanning direction and adjacently disposed in a sub-scanning direction orthogonal to the main scanning direction; and a control unit;

wherein the n laser beams of the first semiconductor laser array are detected by the first beam detection unit while the n laser beams of the second semiconductor laser array are detected by the second beam detection unit; and wherein the control unit controls image formation start positions on the photo conductor of the 2n laser beams on the basis of detection signals output from the first and the second beam detection units.

8. A multi-beam image forming apparatus according to claim 7, wherein, when the n laser beams generated from the second semiconductor laser array are detected by the beam detection unit, the multi-beam generation unit includes a deflection unit that deflects a beam optical path so that the laser beams generated from the second semiconductor laser array are incident on the second beam detection unit.

9. A multi-beam image forming apparatus comprising:

a first semiconductor laser array having n laser elements, wherein n is an integer not smaller than 2;

a second semiconductor laser array having n laser elements;

a multi-beam generation unit that generates 2n laser beams by synthesizing laser beams generated by the first and second semiconductor laser arrays;

a photo conductor;

a scanning unit that scans the photo conductor with the 2n laser beams generated by the multi-beam generation unit;

a beam detection unit including first and second beam detection units disposed in positions shifted by a predetermined distance L1 from each other in a main scanning direction and adjacently disposed in a sub-scanning direction orthogonal to the main scanning direction; and a control unit;

wherein the n laser beams of the first semiconductor laser array are detected by the first beam detection unit while the n laser beams of the second semiconductor laser array are detected by the second beam detection unit; and wherein the control unit controls image formation start positions on the photo conductor of the 2n laser beams on the basis of detection signals output from the first and the second beam detection units.

10. A multi-beam image forming apparatus according to claim 9, wherein, when the n laser beams generated from the second semiconductor laser array are detected by the beam detection unit, the multi-beam generation unit includes a deflection unit that deflects a beam optical path so that the laser beams generated from the second semiconductor laser array are incident on the second beam detection unit.

11. A multi-beam image forming apparatus according to claim 9, further comprising:

an optical element disposed between the scanning unit and the beam detection unit;

wherein the optical element deforms the laser beams generated from the first semiconductor laser array and second semiconductor laser array so that each of the deformed laser beams has a shape allowing the laser beam to be incident on both the first and second beam detection units.

12. A multi-beam image forming apparatus according to claim 11, wherein the control unit controls the first semiconductor laser array and second semiconductor laser array so that the first semiconductor laser array is turned off when each of the laser beams generated from the first semiconductor laser array are incident on the second beam detection unit while the second semiconductor laser array is turned off when each of the laser beams generated from the second semiconductor laser array are incident on the first beam detection unit.

* * * * *